US006413925B2

(12) United States Patent
Akbarian et al.

(10) Patent No.: US 6,413,925 B2
(45) Date of Patent: Jul. 2, 2002

(54) METHOD FOR INCREASING BRIGHTNESS RETENTION OF LAUNDERED FABRICS

(75) Inventors: Fatemah H. Akbarian, Pleasanton; Gregory Van Buskirk, Danville; Heidi J. Torres, San Ramon, all of CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/761,293

(22) Filed: Jan. 16, 2001

Related U.S. Application Data

(63) Continuation of application No. 09/140,618, filed on Aug. 26, 1998, now abandoned.

(51) Int. Cl.[7] ..... C11D 3/00

(52) U.S. Cl. ..... 510/302; 510/303; 510/324; 510/380; 510/499; 510/503; 8/108.1

(58) Field of Search ..... 8/108.1, 137, 159; 510/302, 303, 324, 380, 499, 503

(56) References Cited

U.S. PATENT DOCUMENTS

| | | | | | |
|---|---|---|---|---|---|
| 3,560,389 | A | | 2/1971 | Hunting | 252/95 |
| 3,684,722 | A | | 8/1972 | Hynam | 252/98 |
| 4,863,633 | A | | 9/1989 | Colborn | 252/187.26 |
| 4,900,467 | A | | 2/1990 | Smith | 252/95 |
| 5,011,538 | A | | 4/1991 | Smith | 134/22.13 |
| 5,055,219 | A | | 10/1991 | Smith | 252/102 |
| 5,080,826 | A | | 1/1992 | Colborn | 252/187.26 |
| 5,227,366 | A | | 7/1993 | Swatling | 512/2 |
| 5,336,426 | A | | 8/1994 | Rader | 252/102 |
| 5,389,157 | A | | 2/1995 | Smith | 134/22.13 |
| 5,731,276 | A | * | 3/1998 | Argo et al. | 510/380 |
| 5,833,764 | A | | 11/1998 | Rader | 134/22.11 |
| 6,221,827 | B1 | | 4/2001 | Mendoza Cruz | 510/380 |

* cited by examiner

*Primary Examiner*—Necholus Ogden
(74) *Attorney, Agent, or Firm*—Joel J. Hayashida

(57) ABSTRACT

The invention provides a method for increasing the brightness retention of a laundered fabric after numerous washing cycles by adding to an aqueous wash liquor a quantity of a commercial laundry detergent which delivers at least 0.1 g of an optical brightener into said wash liquor, said optical brightener exhibiting instability in the presence of hypochlorite; and prior to, concurrent with, or after the commercial laundry detergent, adding a bleaching composition in an amount of at least about 0.5 g/L. The bleaching composition contains about 2.5–10% alkali metal hypochlorite; about 0.05–5% of a bleach stable surfactant bearing at least one nitrogen atom; a bleach stable anionic surfactant or a hydrotrope, wherein the ratio of (ii) to (iii) is between about 10:1 to about 1:10; and an effective amount of a source of alkalinity. The fabric is repeatedly washed and the optical brightener is enabled to deposit on the fabric to increase versus a control a Stensby whiteness measure of at least about $\Delta W=4$.

11 Claims, No Drawings

METHOD FOR INCREASING BRIGHTNESS RETENTION OF LAUNDERED FABRICS

RELATED APPLICATIONS

This is a continuation of Ser. No. 09/140,618, filed Aug. 26, 1998 abandoned.

FIELD OF THE INVENTION

The present invention relates to a method for increasing the brightness retention of washed fabrics, where use of commercial laundry detergents in the washing liquor introduces a desirable amount of optical brightener thereto, and the use of hypochlorite bleaches ordinarily reduces the retained brightness, but the special formulation of the bleaches herein surprisingly mitigates the brightness-reducing action of said hypochlorite bleaches. Since it is desirable to use hypochlorite bleaches for their effective cleaning, oxidizing, deodorizing and sanitizing capabilities, the inventive method emphasizes an added advantage thereof.

BACKGROUND OF THE INVENTION

Thickened hypochlorite bleach solutions or compositions have long been used in a variety of applications including hard surface cleaning, disinfecting and the like. These compositions are typically provided with increased viscosity for a number of reasons, principally to increase residence time of the composition on non-horizontal surfaces. However, these compositions have not been used in the laundering of fabrics, typically, because their formulation as thickened cleaners emphasizes their use on surfaces or in drain care products, where the need to adhere to such non-horizontal surfaces, as well as the use of strong alkalis teaches away from use as a laundry additive.

Some references describe the unique phenomena that occurs when certain charge-bearing surfactants, such as quaternary ammonium compounds or betaines, are combined with a source of a counterion. U.S. Pat. Nos. 4,900,467, 5,011,538 and 5,055,219, all issued to Smith (and of common assignment herein), provide exemplary cleaning compositions generally characterized as viscoelastic.

Hynam et al., U.S. Pat. No. 3,684,722, teach that a combination of an amine oxide surfactant (which is referred to in Hynam as a "hydrotrope") and a fatty acid soap will impart desirable thickening attributes to, apparently, a surface cleaner. Although Hynam recognizes that hypochlorites are used in laundry applications, its principal objective is to form a cleaner which can adhere to a vertical surface. (See column 1, lines 55–58; and column 3, lines 43–50). On the other hand, Hunting, U.S. Pat. No. 3,560,389, teaches the use of an amine oxide surfactant combined with what is commonly defined as a hydrotrope, such as sodium xylene sulfonate, but for the purpose of chemically stabilizing the resulting all-in-one "detergent bleach." Because of the requirement in laundry for oxidant-sensitive additives such as enzymes and fluorescent whitening agents, which exhibit instability in the presence of hypochlorite, it is anticipated that the inventive formula would be used in conjunction with a commercially available laundry detergent rather than be used as an all-in-one product. Neither Hynam nor Hunting teach, disclose or suggest that hypochlorite bleaches formulated with effective amounts of bleach stable nitrogen-atom-bearing surfactants and either a bleach stable anionic surfactant or a hydrotrope will surprisingly enhance the brightness retention of fabrics washed therewith in conjunction with a separate, commercial laundry detergent. Further, Colbom et al., U.S. Pat. No. 4,863,633, describes a non-thickened hypochlorite bleach specially formulated with very little (no greater than 100 ppm) surfactant in order to mitigate stress-cracking in thin-walled thermoplastic bottles housing such hypochlorite bleach, such bottles being subject to load-sharing when stacked in corrugated cartons containing such bottles.

SUMMARY OF THE INVENTION AND OBJECTS

In one aspect of the invention, the invention provides a method for increasing the brightness retention of a laundered fabric after numerous washing cycles, said method comprising:

a) adding to an aqueous wash liquor a quantity of a commercial laundry detergent which delivers at least 0.1 g of an optical brightener into said wash liquor;

b) adding prior to, concurrent with, or after step a) a bleaching composition in an amount of at least about 0.5 g/L, wherein said bleaching composition comprises
   (i) about 2.5–10% alkali metal hypochlorite;
   (ii) about 0.05–5% bleach stable surfactant bearing at least one nitrogen atom;
   (iii) a bleach stable anionic surfactant or a hydrotrope, wherein the ratio of (ii) to (iii) is between about 10:1 to about 1:10; and
   (iv) an effective amount of a source of alkalinity;

c) adding prior to, concurrent with, or after steps a) and/or b) at least one fabric work;

d) contacting said fabric work with said wash liquor repeatedly in one washing cycle; and e) repeating steps a) through d) at least five times;

wherein the optical brightener deposited on said fabric work increases versus a control in Stensby whiteness measure of at least about $\Delta W=4$.

It is an object of this invention to improve the brightness retention of fabric works washed in aqueous wash liquors with standard commercial detergents and a specially formulated hypochlorite bleach composition.

It is another object of this invention to provide a hypochlorite bleach with relatively small amounts of surfactants and hydrotropes/anionic surfactants which are nonetheless effective to mitigate the oxidation, destruction or deactivation of optical brighteners contained in commercial laundry detergents used to launder fabrics.

It is yet another object of this invention to improve the appearance of fabrics laundered multiple times, through the enhanced retention of brightness.

It is also an object of this invention to improve the performance one achieves by laundering fabrics with commercial laundry detergents and the specially formulated hypochlorite bleach.

DETAILED DESCRIPTION OF THE PREFERRED EMBODIMENTS

The invention provides a method for increasing the brightness retention of a laundered fabric after numerous washing cycles, said method comprising:

a) adding to an aqueous wash liquor a quantity of a commercial laundry detergent which delivers at least 0.1 g of an optical brightener into said wash liquor;

b) adding prior to, concurrent with, or after step a) a bleaching composition in an amount of at least about 0.5 g/L, wherein said bleaching composition comprises (i) about 2.5–10% alkali metal hypochlorite;

(ii) about 0.05–5% bleach stable surfactant bearing at least one nitrogen atom;

(iii) a bleach stable anionic surfactant or a hydrotrope, wherein the ratio of (ii) to (iii) is between about 10:1 to about 1:10; and (iv) an effective amount of a source of alkalinity;

c) adding prior to, concurrent with, or after steps a) and/or b) at least one fabric work;

d) contacting said fabric work with said wash liquor repeatedly in one washing cycle; and e) repeating steps a) through d) at least five times;

wherein the optical brightener deposited on said fabric work increases versus a control in Stensby whiteness measure of at least about $\Delta W=4$.

The individual constituents of the specially formulated bleach used in the inventive method are described more particularly below. As used herein, all percentages are weight percentages of actives, unless otherwise specified. Additionally, the term "effective amount" means an amount sufficient to accomplish the intended purpose, e.g., cleaning, suspending, etc.

The formulations of this invention are not necessarily thickened, yet can, without preference, develop viscosities in the range of 20–5,000 centipoise (cPs). Despite a lack of preference therefor, some of the specially formulated bleach of the invention can nonetheless have body and could suspend certain desirable additives, such as colorants, and could also be delivered via pump sprayers or nozzles, such as for pre-spotting fabrics.

1. Hypochlorite Bleach

A hypochlorite-generating compound or bleach source is a principal ingredient. This oxidant chemical provides good stain and soil removal and is additionally a broad spectrum antimicrobial agent. The hypochlorite bleach source may be selected from various hypochlorite-producing species, for example, bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite may also be suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromocyanuric acid, dibromo and dichlorocyanuric acid, and potassium and sodium salts thereof, N-brominated and N-chlorinated succinimide, malonimide, phthalimide and naphthalimide. Also potentially suitable are hydantoins, such as dibromo and dichlorodimethylhydantoin, chlorobromodimethylhydantoin, N-chlorosulfamide (haloamide) and chloramine (haloamine). Particularly preferred in this invention is alkali metal hypochlorite, namely, sodium, potassium and lithium hypochlorite, and mixtures thereof.

In this invention, it is possible to use an alkali metal hypochlorite bleach which has a relatively low salt content. For example, hypochlorite bleaches are commonly formed by bubbling chlorine gas through liquid sodium hydroxide or corresponding metal hydroxide to result in formation of the corresponding hypochlorite, along with the co-formation of a salt such as sodium chloride. In other contexts, it has been found desirable to use hypochlorites formed for example by reaction of hypochlorous acid with alkali metal hydroxide in order to produce the corresponding hypochlorite with water as the only substantial by-product. Hypochlorite bleach produced in this manner is referred to as "high purity, high strength" bleach, or also, as "low salt, high purity" bleach, and is available from a number of sources, for example Olin Corporation which produces hypochlorite bleach as a 30% solution in water. The resulting solution could then diluted to produce the hypochlorite strength suitable for use in the present invention.

The hypochlorite may be formed with other alkaline metals as are well known to those skilled in the art. Although the term "hypochlorite" is employed herein, it is not intended to limit the invention only to the use of chloride compounds but is also intended to include other halides or halites, as discussed above.

The hypochlorite and any salt present within the composition can be a source of ionic strength for the composition, although the buffer/electrolyte also plays a significant role. The ionic strength of the composition may also have an effect on thickening.

The hypochlorite is preferably present in an amount ranging from about 2.5 weight percent to about 10 weight percent, more preferably about 3.0% to 7.5%, and most preferably about 5.0% to 7.0%.

2. Bleach Stable Surfactants with at least one Nitrogen Atom

Betaines and their derivatives, especially $C_{10-20}$ betaines, are most preferred for use in the specially formulated bleach compositions of the invention. This definition includes both alkylbetaines, sulfoalkylbetaines, alkylamido-alkyl di-short-chain alkyl betaines and mixtures thereof. Particularly preferred are betaines such as those described in the patents to Choy et al., U.S. Pat. Nos. 4,599,186, 4,657,692, 4,695,394, and Garabedian et al., U.S. Pat. Nos. 5,252,245 and 5,437,807, and 5,468,423, all of common assignment herewith and the disclosures of which are incorporated herein by reference. Quaternary ammonium surfactants, which are cationic compounds, are not preferred alone, although they can be used in combination with other nitrogen-containing surfactants.

Among the preferred bleach stable surfactants are the amine oxides, especially trialkyl amine oxides, as represented below.

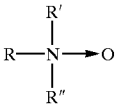

This can be referred to as a mono-short chain $C_{1-4}$ alkyl, di-long chain $C_{10-20}$ alkyl amine oxides. In the structure above, R' and R" can be alkyl of 1 to 3 carbon atoms, and are most preferably methyl, and R is alkyl of about 10 to 20 carbon atoms. When R' and R" are both methyl and R is alkyl averaging about 12 carbon atoms, the structure for dimethyldodecylamine oxide, a preferred amine oxide, is obtained. Other preferred amine oxides include the $C_{14}$ alkyl (tetradecyl) and $C_{16}$ (hexadecyl) amine oxides. It is acceptable to use mixtures of any of the foregoing. Representative examples of these particular type of bleach-stable nonionic surfactants include the dimethyldodecylamine oxides sold under the trademarks AMMONYX® LO and CO by Stepan Chemical. Yet other preferred amine oxides are those sold under the trademark BARLOX® by Stepan, Conco XA sold by Continental Chemical Company, AROMAX* sold by Akzo, and SCHERCAMOX* sold by Scher Brothers, Inc. These amine oxides preferably have main alkyl chain groups averaging about 10 to 20 carbon atoms.

The invention can also beneficially include mixtures of such amine oxides and betaines.

The bleach stable surfactant with at least one nitrogen atom is present in a range of, generally about 0.05 to 5% by weight, more preferably about 0.2 to 2% by weight.

3. Bleach Stable Anionic Surfactant and/or Hydrotrope

The additional co-surfactant added to the specially formulated hypochlorite bleaches of this invention are bleach stable anionic surfactants and hydrotropes. The bleach stable anionic surfactants include alkali metal alkyl sulfates, alkylarylsulfonates, primary and secondary alkane sulfonates (also referred to as paraffin sulfonates), alkyl diphenyloxide disulfonates, and mixtures thereof. The anionic surfactants will have alkyl groups preferably averaging about 8 to 20 carbon atoms. The alkyl arylsulfonic acid salts of preference are linear alkylbenzene sulfonates, known as LAS's. Typical LAS's have $C_{8-16}$ alkyl groups, examples of which include Stepan Company's Biosoft, and Pilot Chemical Company's Calsoft. Still further suitable surfactants are the alkyldiphenylether disulfonates (also called alkyldiphenyloxide disulfonates), such as those sold by Dow Chemical Company under the name "Dowfax," e.g., Dowfax 3B2. Still other potentially suitable anionic surfactants include alkali metal alkyl sulfates such as Conco Sulfate WR, sold by Continental Chemical Company, which has an alkyl group of about 16 carbon atoms; and secondary alkane sulfonates such as Hostapur SAS, manufactured by Farbwerke Hoechst AG. Hydrotropes, on the other hand, are dispersants which do not form a critical micelle concentration (CMC) in water (See Colbom et al, U.S. Pat. No. 4,863,633, column 8, line 20 through column 10, line 22, incorporated herein by reference). These hydrotropes may interact with some of the bleach stable surfactants bearing at least one nitrogen atom to form thickened, viscoelastic formulations, although it is again emphasized that the thickening phenomenom is not critical to the enhanced brightness retention of the invention. The hydrotropes are preferably selected from short chain alkylarylsulfonates, salts of benzoic acid, benzoic acid derivatives (such as chlorobenzoic acid), and mixtures thereof. As used herein, aryl includes benzene, naphthalene, xylene, cumene and similar aromatic nuclei. These aryl groups can be substituted with one or more substituents known to those skilled in the art, e.g., halo (chloro, bromo, iodo, fluoro), nitro, or $C_{1-4}$ alkyl or alkoxy. Most preferred is sodium xylene sulfonate (such as Stepanate SXS, available from Stepan Company). The bleach stable anionic surfactant and/or hydrotrope should be present in a ratio with the bleach stable surfactant with at least one nitrogen atom (described above in 2.) between about 10:1 to about 1:10.

4. Alkali Metal Soap

An optional component is alkali metal soap (alkyl carboxylates). The soaps utilized are typically formed in situ, by using the appropriate carboxylic acid (e.g., a $C_{6-18}$ carboxylic acid, such as, without limitation, lauric, stearic, myristic acids, and unsaturated acids, such as coco fatty acid), and neutralizing with e.g., sodium hydroxide (NaOH). Other alkali metal hydroxides, such as potassium and lithium hydroxides, can be utilized. Commercial sources of these fatty acids include Henkel Corporation's Emery Division. The soap should be present in an amount of about 0.1 to 5%, more preferably 0.5 to 3% by weight.

5. Buffers/Electrolytes pH adjusting agents may be added to adjust the pH, and/or buffers may act to maintain pH. In this instance, alkaline pH is favored for maintaining hypochlorite stability and, surprisingly, to further heighten brightness retention. Examples of buffers include the alkali metal silicates, metasilicates, polysilicates, carbonates, bicarbonates, sesquicarbonates, hydroxides, orthophosphates, metaphosphates, pyrophosphates, polyphosphates and mixtures of the same. Where the active halogen source is sodium hypochlorite, the pH is maintained above about pH 10.5, preferably above or about pH 12. Most preferred for this purpose are the alkali metal hydroxides, especially sodium, potassium, or lithium hydroxide. The total amount of pH adjusting agent/buffer including that inherently present with bleach plus any added, can vary from about 0.1% to 5%, preferably from about 0.1–2.5%.

6. Water

It should be briefly noted that the main ingredient in the inventive compositions is water, preferably softened, distilled or deionized water. Water provides the continuous liquid phase into which the other ingredients are added to be dissolved/dispersed. The amount of water present generally exceeds 80% and, indeed, can be as high as 98%, although generally, it is present in a quantity sufficient (q.s.) to take up the remainder of the specially formulated bleaches of the invention.

7. Optional Ingredients

The composition of the present invention can be formulated to include such components as fragrances, coloring agents, additional whiteners, solvents, chelating agents and builders, which enhance performance, stability or aesthetic appeal of the composition. From about 0.01% to about 0.5% of a fragrance such as those commercially available from International Flavors and Fragrance, Inc. may be included, although it should be noted that many solvents described hereinbelow may actually perform in place of such fragrances. These include certain less water soluble or dispersible organic solvents, some of which are advantageously hypochlorite bleach stable. These bleach stable solvents include those commonly used as constituents for proprietary fragrance blends, such as terpene derivatives. The terpene derivatives herein include terpene hydrocarbons with a functional group. Effective terpenes with a functional group include, but are not limited to, tertiary alcohols and ethers. Representative examples for each of the above classes of terpenes with functional groups include but are not limited to the following: Terpene alcohols, including, for example, cis-2-pinanol, pinanol, thymol, 1,8-terpin, dihydroterpineol, tetrahydromyrcenol, tetrahydrolinalool, and tetrahydro-alloocimenol; and terpene ethers, including, for example, benzyl isoamyl ether, 1,8-cineole, 1,4-cineole, isoboron methylether, methyl hexylether. Further, other tertiary alcohols are useful herein. Additional useful solvents include alicyclic hydrocarbons, such as methylcyclohexane. Terpene hydrocarbons with functional groups which appear suitable for use in the present invention are discussed in substantially greater detail by Simonsen and Ross, *The Terpenes,* Volumes I-V, Cambridge University Press, 2nd Ed., 1947 (incorporated herein by reference thereto). See also, Choy, U.S. Pat. No. 5,279,758, incorporated herein by reference thereto. It is preferred to add about 0.05 to about 5% solvent, more preferably about 0.05 to 3% and most preferably about 0.05 to about 2.5%, of the bleach stable solvent herein. Mixtures of any of the foregoing solvents are also useful herein. Dyes and pigments may be included in small amounts. Ultramarine Blue (UMB) and copper phthalocyanines are examples of widely used pigments which may be incorporated in the composition of the present invention.

EXPERIMENTAL

In the following section, experiments were run to demonstrate the surprisingly retained brightness of the fabrics washed according to the inventive method. The fabrics can be preferably selected from cotton-containing fabrics, such as cotton, polycotton; and polyester fabrics. They are washed in standard U.S. automatic washing machines, such as those manufactured by Whirlpool Corporation, Benton Harbor, Mich., Maytag Corporation, Newton, Iowa, and other manufacturers. These machines typically have about a 69 liter (L) capacity when filled. Although the standard washing machine is top loading, a rather recent development, spearheaded by European manufacturers, such as Miele, is the front loading machine, which uses less water per washload.

In the experiments, standard commercial laundry detergents were used. These included Ultra Tide® (Procter & Gamble). These formulations were added in amounts such as to add about 0.5–2 grams/liter (g/L) of detergent per washload, as per package instructions. This was calculated to delivered at least about 0.1 g of optical brightener per washload. Although it is not certain, it is believed that the brighteners are standard compounds such as stilbene or styrylbiphenyl derivatives. Optical brighteners are also referred to as fluorescent whitening agents, or FWA's. They are fluorescent materials which fluoresce by absorbing ultraviolet wavelength light and emitting visible light, generally in the color blue wavelength ranges. The whiteners settle out or deposit onto fabrics during the washing cycle. See also, Mitchell et al., U.S. Pat. No. 4,900,468, column 5, line 66 to column 6, line 27, incorporated herein by reference.

The machines typically have a fill/wash cycle of about 12 minutes (the initial volume of water is added), a rinse cycle of about 2 minutes (sufficient water added to disperse the soil and detergent and other laundry additives, including the specially formulated bleach compositions of the invention) and a spin cycle of about 10 minutes. Between the wash, rinse and spin cycles the introduced water is drained. These "interim" cycles are to be distinguished from the wash cycle itself, which encompasses all these steps.

In the experiments, a baseline is established by "reading", with a Gardner calorimeter, a 100% cotton white swatch before and after washing, in one cycle, with a standard hypochlorite bleach product (containing no surfactants or hydrotropes), and after five cycles. The data are then calculated and compared according to the Stensby equation $(L_w+3a_w-3b_w)-(L_s-3a_s-3b_s)$. The resulting measure is thus simplified as the difference between final brightness and initial brightness and expressed as ΔW.

In the following Table I, various bleach stable surfactants (with at least one nitrogen atom), namely, a cocoamidopropylbetaine, a dodecylamine oxide (Ammonyx MO and Barlox 12), and bleach stable anionic surfactant (Dowfax 3B2) and a hydrotrope (sodium xylene sulfonate) were tested as additives to the specially formulated hypochlorite bleach of the invention. A quaternary ammonium compound was also tested, but found not preferred, except when in combination with other nitrogen-containing surfactants. The Stensby whiteness measure, ΔW, was achieved by first: the initial brightness was measured on the calorimeter before washing; then after cycle 1; and finally, after cycle 5. Cycle 5 means after 5 washes. In the first run of experiments, a baseline reading of ΔW=3.74 (LSD=0.342) was calculated. So, improvements of at least about 4 were considered significant and surprising, since it would not have been expected that the addition of surfactants/hydrotropes alone would increase brightness retention.

TABLE I

| Eg. | SXS[1] | Betaine[2] | Amine Oxide[3] | Amine Oxide[4] | DPODS[5] | Cycle 1 delta W | Cycle 5 delta W |
|---|---|---|---|---|---|---|---|
| 1 | 0 | 0 | 0 | 0 | 0 | 1.64 | 3.74 |
| 2 | 0 | 0 | 0 | 1.2 | 1.2 | 1.29 | 3.98 |
| 3 | | | 1.2 | | 1.2 | 1.53 | 4.24 |
| 4 | | | 1.2 | 1.2 | | 1.73 | 4.20 |
| 5 | | 0.4 | | | 1.2 | 1.69 | 4.54 |
| 6 | | 0.4 | | | 1.2 | 1.74 | 4.41 |
| 7 | | 0.4 | | 1.2 | | 1.86 | 4.69 |
| 8 | | 0.4 | 1.2 | | | 2 | 4.7 |
| 9 | 0.4 | | | 1.2 | | 1.76 | 4.47 |
| 10 | 0.4 | | 1.2 | | | 1.85 | 4.36 |
| 11 | 0.4 | | 1.2 | 1.2 | 1.2 | 1.76 | 5.11 |
| 12 | 0.4 | 0.4 | | | | 1.84 | 4.8 |
| 13 | 0.4 | 0.4 | | 1.2 | 1.2 | 1.8 | 4.93 |
| 14 | 0.4 | 0.4 | 1.2 | | 1.2 | 1.58 | 4.41 |

[1]Sodium Xylene Sulfonate
[2]Cocoamidopropyldimethylbetaine
[3]Ammonyx MO
[4]Barlox 12
[5]Diphenyloxidedisulfonate The foregoing invention is further defined without limitation of scope or equivalents by the claims which follow.

What is claimed is:

1. A method for increasing the brightness retention of a laundered fabric after numerous washing cycles, said method comprising:

a) adding to an aqueous wash liquor a quantity of a commercial laundry detergent which delivers at least 0.1 g of an optical brightener into said wash liquor;

b) adding prior to, concurrent with, or after step a) a bleaching composition in an amount of at least about 0.5 g/L, wherein said bleaching composition comprises (i) about 2.5–10% alkali metal hypochlorite;

(ii) about 0.05–5% of a bleach stable surfactant bearing at least one nitrogen atom, said bleach stable surfactant being selected from the group consisting of alkylbetaines, alkylamidopropyl-di-short-chain-alkylbetaines, mono-long-chain-alkyl, di-short-chain-alkyl amine oxides, alkylamidopropyl-di-short-chain-alkyl amine oxides, and mixtures thereof;

(iii) a bleach stable anionic surfactant or a hydrotrope, said anionic surfactant or the hydrotrope being selected from the group consisting of long chain alkylarylsulfonates, dialkyldiphenyloxide disulfonates, short chain alkylarylsulfonates, salts of benzoic acid, benzoic acid derivatives, and mixtures thereof, wherein the weight ratio of (ii) to (iii) is between about 10:1 to about 1:10; and (iv) an effective amount of a source of alkalinity;

c) adding prior to, concurrent with, or after steps a) and/or b) at least one fabric work;

d) contacting said fabric work with said wash liquor repeatedly in one washing cycle; and e) repeating steps a) through d) at least five times.

2. The method of claim 1 wherein said wash cycle comprises a filling cycle, a laundering cycle, a rinse cycle and a spin cycle.

3. The method of claim 2 wherein each cycle which requires the introduction of water is followed at a discrete time by a drain step.

4. The method of claim 1 wherein said fabric work is selected from the group consisting of cotton-containing and polyester fabrics.

5. A fabric work which is repeatedly laundered in numerous wash cycles, wherein said fabric work is placed into a rotatable container containing a wash liquor, said wash liquor including about 0.5–2 grams/Liter of a commercial laundry detergent which delivers at least 0.1 g of an optical brightener into said wash liquor; and a bleaching composition in an amount of at least about 0.5 g/L, wherein said bleaching composition comprises (i) about 2.5–10% alkali metal hypochlorite;

(ii) about 0.05–5% of a bleach stable surfactant bearing at least one nitrogen atom, said bleach stable surfactant being selected from the group consisting of alkylbetaines, alkylbetaines, alkylamidopropyl-di-short-chain-alkylbetaines, mono-long-chain-alkyl, di-short-chain-alkyl amine oxides, alkylamidopropyl-di-short-chain-alkyl amine oxides, and mixtures thereof;

(iii) a bleach stable anionic surfactant or a hydrotrope, said anionic surfactant or the hydrotrope being selected from the group consisting of long chain alkylarylsulfonates, dialkyldiphenyloxide disulfonates, short chain alkylarylsulfonates, salts of benzoic acid, benzoic acid derivatives, and mixtures thereof, wherein the weight ratio of (ii) to (iii) is between about 10:1 to about 1:10; and (iv) an effective amount of a source of alkalinity.

6. A method for increasing the brightness retention of a laundered fabric after numerous washing cycles, said method comprising:

a) adding to an aqueous wash liquor about 0.5–2 grams/Liter of a commercial laundry detergent which delivers at least 0.1 g of an optical brightener into said wash liquor;

b) adding prior to, concurrent with, or after step a) a bleaching composition in an amount of at least about 0.5 g/L, wherein said bleaching composition comprises (i) about 2.5–10% alkali metal hypochlorite;

(ii) about 0.05–5% of a bleach stable surfactant bearing at least one nitrogen atom, said bleach stable surfactant being selected from the group consisting of alkylbetaines, alkylamidopropyl-di-short-chain-alkylbetaines, mono-long-chain-alkyl, di-short-chain-alkyl amine oxides, alkylamidopropyl-di-short-chain-alkyl amine oxides, and mixtures thereof;

(iii) a bleach stable anionic surfactant or a hydrotrope, said anionic surfactant or the hydrotrope being selected from the group consisting of long chain alkylarylsulfonates, dialkyldiphenyloxide disulfonates, short chain alkylarylsulfonates, salts of benzoic acid, benzoic acid derivatives, and mixtures thereof, wherein the weight ratio of (ii) to (iii) would be between about 10:1 to about 1:10; and (iv) an effective amount of a source of alkalinity;

c) adding prior to, concurrent with, or after steps a) and/or b) at least one fabric work;

d) contacting said fabric work with said wash liquor repeatedly in one washing cycle; and e) repeating steps a) through d) at least five times.

7. A method for increasing the brightness retention of a laundered fabric after numerous washing cycles, said method comprising:

a) adding to an aqueous wash liquor a quantity of a commercial laundry detergent which delivers at least 0.1 g of an optical brightener into said wash liquor;

b) adding prior to, concurrent with, or after step a) a bleaching composition in an amount of at least about 0.5 g/L, wherein said bleaching composition comprises (i) about 2.5–10% alkali metal hypochlorite;

(ii) about 0.05–5% of a bleach stable surfactant bearing at least one nitrogen atom, said bleach stable surfactant being selected from the group consisting of alkylbetaines, alkylamidopropyl-di-short-chain-alkylbetaines, mono-long-chain-alkyl, di-short-chain-alkyl amine oxides, alkylamidopropyl-di-short-chain-alkyl amine oxides, and mixtures thereof;

(iii) a bleach stable anionic surfactant or a hydrotrope, said anionic surfactant or the hydrotrope being selected from the group consisting of long chain alkylarylsulfonates, dialkyldiphenyloxide disulfonates, short chain alkylarylsulfonates, salts of benzoic acid, benzoic acid derivatives, and mixtures thereof, wherein the weight ratio of (ii) to (iii) would be between about 10:1 to about 1:10; and (iv) an effective amount of a source of alkalinity;

c) adding at least one fabric work after both step a) and step b);

d) contacting said fabric work with said wash liquor repeatedly in one washing cycle; and e) repeating steps a) through d) at least five times.

8. The method of claim 7 wherein said wash cycle comprises a filling cycle, a laundering cycle, a rinse cycle and a spin cycle.

9. The method of claim 8 wherein each cycle which requires the introduction of water is followed at a discrete time by a drain step.

10. The method of claim 7 wherein said fabric work is selected from the group consisting of cotton-containing and polyester fabrics.

11. A fabric work which is repeatedly laundered in a numerous wash cycle, wherein said fabric work is placed into a rotatable container containing a wash liquor, said wash liquor including about 0.5–2 grams/Liter of a commercial laundry detergent which delivers at least 0.1 g of an optical brightener into said wash liquor; and a bleaching composition in an amount of at least about 0.5 g/L, wherein said bleaching composition comprising:

(i) about 2.5–10% alkali metal hypochlorite;

(ii) about 0.05–5% of a bleach stable surfactant bearing at least one nitrogen atom, said bleach stable surfactant being selected from the group consisting of alkylbetaines, alkylamidopropyl-di-short-chain-alkylbetaines, mono-long-chain-alkyl, di-short-chain-alkyl amine oxides, alkylamidopropyl-di-short-chain-alkyl amine oxides, and mixtures thereof;

(iii) a bleach stable anionic surfactant or a hydrotrope, said anionic surfactant or the hydrotrope being selected from the group consisting of long chain alkylarylsulfonates, dialkyldiphenyloxide disulfonates, short chain alkylarylsulfonates, salts of benzoic acid, benzoic acid derivatives, and mixtures thereof, wherein the weight ratio of (ii) to (iii) is between about 10:1 to about 1:10; and (iv) an effective amount of a source of alkalinity.

* * * * *